United States Patent [19]

Smith

[11] Patent Number: 4,733,714

[45] Date of Patent: Mar. 29, 1988

[54] METHOD OF AND APPARATUS FOR CASTING

[75] Inventor: Robert A. Smith, Newbury, United Kingdom

[73] Assignee: Cosworth Research & Development Limited, Worcester, United Kingdom

[21] Appl. No.: 17,703

[22] Filed: Feb. 24, 1987

Related U.S. Application Data

[63] Continuation of Ser. No. 16,218, Feb. 19, 1987.

[30] Foreign Application Priority Data

Feb. 21, 1986 [GB] United Kingdom ..... 8604386

[51] Int. Cl.[4] ..... B22D 23/00

[52] U.S. Cl. ..... 164/130; 164/136; 164/337; 164/323; 164/360; 164/119; 164/306

[58] Field of Search ..... 164/136, 119, 306, 309, 164/337, 130, 323, 129, 360

[56] References Cited

U.S. PATENT DOCUMENTS 3,863,704 2/1975 Kahn ..... 164/136 X
4,008,749 2/1977 Bellocci et al. ..... 164/119 X

FOREIGN PATENT DOCUMENTS 2408032 9/1975 Fed. Rep. of Germany ..... 164/136
2080714 2/1982 United Kingdom ..... 164/136

*Primary Examiner*—Kuang Y. Lin
*Attorney, Agent, or Firm*—Marshall, O'Toole, Gerstein, Murray & Bicknell

[57] ABSTRACT

A method of making a casting comprising the steps of, at a casting station, feeding molten metal from a primary source of molten metal into a mould cavity through an ingate below the top of the mould cavity, placing the cavity out of feeding relationship with the primary source by changing the orientation of the cavity relative to the direction of gravity to prevent flow of molten metal from the cavity towards the primary source and to permit of flow of metal from a secondary source to the cavity, the cavity being continuously connected to the primary source during said change of orientation, transferring the mould cavity to a cooling station spaced from the casting station and, at the cooling station, permitting molten metal to flow to the cavity from the secondary source while the metal in the cavity solidifies.

31 Claims, 10 Drawing Figures

METHOD OF AND APPARATUS FOR CASTING

This application is a continuation of my copending application Ser. No. 016,218 filed Feb. 19, 1987.

BACKGROUND OF THE INVENTION

This invention relates to a method of and apparatus for making a casting by feeding molten metal from a source of the molten metal into a mould cavity through an ingate below the top of the mould cavity. The invention is particularly, but not exclusively, concerned with a method and apparatus for making a casting by feeding molten metal generally upwardly from the source thereof into the mould cavity through an ingate at the bottom of the mould cavity, for example, by pumping the metal upwardly under low pressure from a reservoir disposed below the level of the mould cavity through an ingate at the bottom of the mould cavity.

Hitherto foundries have made castings by this method by allowing the metal to solidify within the mould cavity and subsequently placing the mould cavity out of feeding relationship with the source of molten metal and placing a further mould cavity in feeding relationship with the source of the metal for repetition of the method.

A majority of the time taken to make a casting by this method is occupied in waiting for the metal to solidify in the mould cavity before the source of metal can be placed out of feeding relationship with the mould cavity and placed in feeding relationship with a further mould cavity and the casting cycle repeated.

SUMMARY OF THE INVENTION

An object of the invention is to provide a method of and an apparatus for making a casting in which the rate of production of castings is improved compared with known methods and apparatus.

According to one aspect of the invention we provide a method of making a casting comprising the steps of, at a casting station, feeding molten metal from a primary source of molten metal into a mould cavity through an ingate below the top of the mould cavity, placing the cavity out of feeding relationship with the primary source by changing the orientation of the cavity relative to the direction of gravity to prevent flow of molten metal from the cavity towards the primary source and to permit flow of metal from a secondary source to the cavity, the cavity being continuously connected to the primary source during said change of orientation, transferring the mould cavity to a cooling station spaced from the casing station and, at the cooling station, permitting molten metal to flow to the cavity from the secondary source whilst the metal in the cavity solidifies.

In this specification reference to an ingate at the bottom of the mould cavity is intended to cover not only an ingate which opens through a bottom wall of the cavity but also an ingate which opens through a side wall of the cavity with at least part of the ingate being disposed within the bottom half of the overall height of the mould cavity and preferably with the bottom part of the ingate being at or substantially at the level of the bottom wall of the cavity. It is however much preferred that the ingate opens through said bottom, upwardly facing, wall of the cavity so that the flow of metal through the ingate is substantially vertically upwardly.

Where in this specification it is stated that the metal in the mould cavity may be subjected to a low pressure we mean for example, sufficient pressure only to ensure that the cavity is filled and to maintain a small head, for example, 1 to 3 inches of metal equivalent, to ensure that the cavity remains full whilst the cavity is placed out of said feeding relationship. Typically the lower pressure is less than 1 bar, although, if desired, the pressure may be higher than this.

According to another aspect of the invention we provide an apparatus for making a casting comprising a primary source for molten metal, a mould having a mould cavity, feed means to feed molten metal, in use, from the primary source into the mould cavity through an ingate below the top of the mould cavity, when the mould is at a casting station, means for placing the mould cavity out of feeding relationship with the primary source comprising means for changing the orientation of the mould cavity relative to the direction of gravity to prevent flow of molten metal from the cavity towards the primary source and to permit of flow of metal from a secondary source to the cavity, means continuously to connect the cavity with the primary source during said change of orientation, means to transfer the mould cavity to a cooling station spaced from the casting station where at molten metal may flow to the cavity from the secondary source whilst the metal in the cavity solidifies.

According to another aspect of the invention we provide a casting when made by the method of the first aspect or using the apparatus of the second aspect of the invention.

BRIEF DESCRIPTION OF THE DRAWINGS

Embodiments of the invention will not be described by way of example with reference to the accompanying drawings wherein.

DESCRIPTION OF THE PREFERRED EMBODIMENTS

Figure 1:
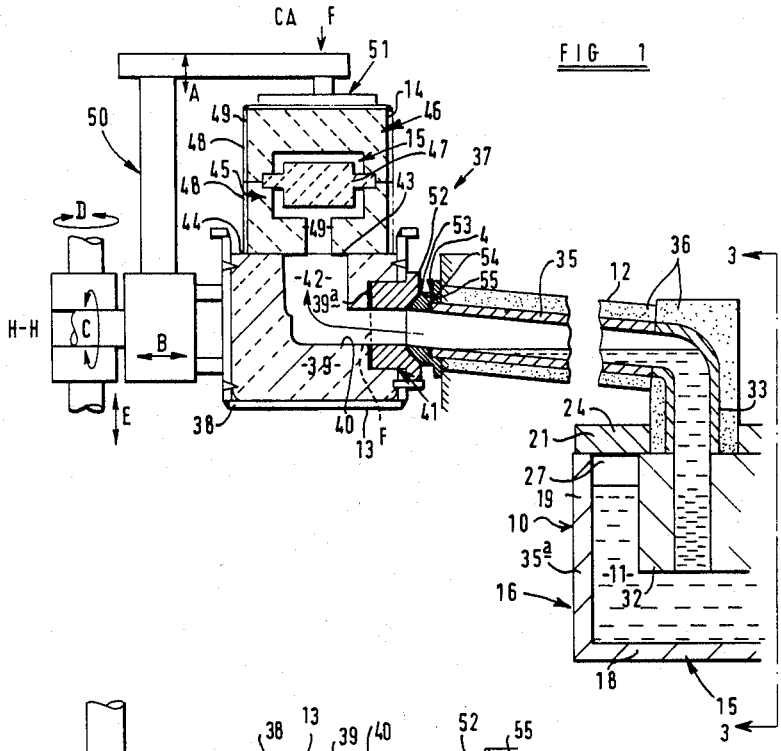
FIG. 1 is a diagramatic cross-sectional view through a first embodiment of the invention showing an apparatus in position ready for feeding metal from a primary source into the mould cavity.

Referring now to FIGS. 1 to 4, there is shown an apparatus for making metal castings comprising a primary source 10 of molten metal 11 connected by a launder system 12 to a mould support 13. Supported on the mould support 13 is a mould 14 having a mould cavity 15. The metal 11 to be cast is in this example an aluminium alloy known as LM 25 but may be any other aluminium alloy or any other metal castable by a "low pressure" means for example magnesium, zinc, lead, copper and alloys of any of these. Ferrous metals may also be cast. Of course the precise components used are chosen so as to be suitable for the metal to be cast.

The primary source 10, in the present example, comprises a melter/holder furnace 16 comprising a refractory lined reservoir vessel 17 having a rectangular base 18 and vertical side and end walls 19,20 respectively. A roof 21 extends across the whole width of the vessel 17 but stops short of the end walls 20 to provide a charging well 22 and a pump well 23 at opposite ends of the vessel.

The roof 21 comprises a generally horizontal rectangular top part 24 and vertical side and end walls 25 and 26 respectively. The roof 21 comprises suitable refractory material and within the roof are provided electrical radiant heaters 27.

The temperature of the heaters 27 and the number thereof and the area of the top part 24 of the roof are arranged so as to provide sufficient heat to melt ingots fed into the vessel 17 at the charging well 22 and to maintain the metal molten in the remainder of the vessel. A downwardly depending refractory wall 28 is provided at the charging well end of the vessel to separate the charging well 22 from the main heating part of the vessel whilst downwardly depending and upwardly extending refractory walls 29, 30 are provided at the pump well end of the vessel to define a casting vessel region 31 within which a pump 32, separate from the vessel 17 is provided. In the present example the pump is an electromagnetic pump which pumps metal from the region 31 through a riser tube 33. If desired a filter 34 may be provided between the walls 29 and 30 to filter metal entering the casting vessel region 31. The riser tube 33 and pump 32 provide a passage which has a lower end immersed in the molten metal and an upper end externally of the vessel 17 and an intermediate portion which extends through the free upper surface 34 of the molten metal.

If desired any other form of suitable pump separate from the reservoir vessel 17 may be provided such as a pressure pump in which metal is drawn into a body disposed within the reservoir and discharged therefrom by variation of pressure within the body through a riser tube as described in connection with the pump 32.

Alternatively, and not illustrated, the metal may be pumped upwards through a riser tube, corresponding to the riser tube 32, by providing the primary source as a reservoir vessel which has an air tight enclosure and pressurizing the whole of the interior of the vessel to force metal upwardly through the riser tube which, preferably, provides a passage having a lower end immersed in the molten metal, an upper end externally of the vessel and an intermediate portion which extends upwardly through the free upper surface of the molten metal. This version is particularly suitable where the metal to be cast is a ferrous metal since the electromagnetic pump 32 illustrated is not suitable for use with ferrous metals.

Furthermore, however the metal is pumped, the metal may be fed to the reservoir vessel in molten state rather than in solid state if it is desired not to provide the primary source 16 in the form of a melter/holder furnace.

The riser tube 33 comprises part of the launder system 12 and from the upper end of the riser tube 33 there extends a generally horizontal but slightly upwardly inclined conduit 35. The riser tube 33 and conduit 35 are surrounded by thermally insulating material 36 and may be provided with heaters.

The conduit 35 is connected to the mould support 13 by a separable rotary joint 37. The joint 37 permits of rotation about a horizontal axis, between the mould support 13 and the conduit 35 and also permits of movement of the mould support 13 from a casting station CA as shown in FIGS. 1 to 4 to a cooling station CO spaced from the casting station.

The mould support 13 comprises a steel open-topped box 38 containing a refractory mass 39 in which is formed a conduit 40 for molten metal which extends generally horizontally from an entry port 41 to a header portion 42 which extends generally upwardly to an exit port 43 of the mould support. The volume of the header portion 42 is arranged so as to contain sufficient metal to provide a secondary source of molten metal for the feeding of the cavity 15 as hereinafter to be described.

Supported on the top surface 44 of the mould support is the mould 14. In the present example the mould 14 comprises cope and drag parts 45, 46 respectively, comprising bonded sand and defining there between the mould cavity 15 in which at least one core 47 is disposed.

The cope and drag parts 45, 46 comprise mould boxes 48 within which the bonded sand is disposed and the cavity 15 is provided with an ingate 49.

Although in the example illustrated there is only a single mould cavity and a single header portion connected directly to the cavity by an ingate 49, if desired a plurality of cavities may be provided in each mould. The or each cavity may contain one or more cores. The or each cavity may be connected to one or more header portions by one or more ingates for the or each cavity. For example, there may be a single header portion having a channel from which a plurality of ingates extend. Where there are a plurality of cavities there may be a single ingate for each cavity or a plurality of ingates for at least some of the cavities. Hereinafter reference to header, mould cavity and ingate are to be understood to refer also to these in the plural. If desired the cope and drag parts may be made in boxless form, one example of which is described hereinafter with reference to FIG. 5, and/or the mould may comprise more than two parts.

The steel box 38 is releasably connected to a manipulator 50 provided with a clamp plate 51 by which the mould 14 is clamped to the mould support 13. Clamp plate 51 is moveable in the direction of the arrow A whilst the manipulator is capable of moving the mould box 38 horizontally in the direction of the arrow B vertically in the direction of the arrow E and it can rotate the box 38 (and hence the mould 14 together with the mould support 13) about a horizontal axis H—H as indicated by the arrow C and about a vertical axis as indicated by the arrow D.

The rotatable joint 37 permits of rotation between the first and second conduits 35, 40 and provides a seal therebetween. The joint 37 comprises a first member 52 received in a recess in the refractory mass 39 with a jointing gasket 39*a* therebetween and hence fixed relative to the conduit 40. The member 52 has a frusto-conical recess 53 therein which co-operates with a part spherical surface 54 of a second member 55 fixed relative to the conduit 35. The members 52, 55 are made of refractory or refractory faced materials which can maintain a seal therebetween and not abrade each other unduly typically relatively hard material and the other less hard. By providing joint faces which are part conical and part spherical as described above a degree of misalignment can be accommodated.

Figure 4:
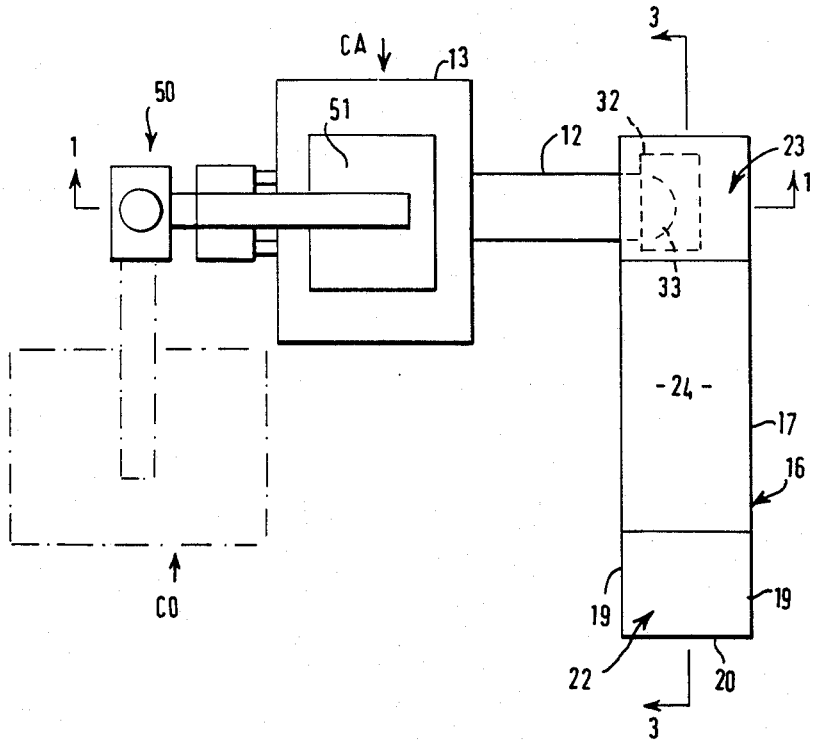
FIG. 4 is a diagramatic plan view of the apparatus of FIG. 1.

In use, a mould 14 is clamped to the upper surface 44 of the mould support 13 by the clamping plate 51 of the manipulator 50 and the manipulator 50 manipulates the assembly so as to move the sealing surfaces 53, 54 of the rotary joint 37 into sealing engagement, with the mould 14 disposed above the mould support 13 at the casting station CA, as shown in FIGS. 1 and 4. The pump 32 is then operated to pump metal upwardly out of the vessel 17 through the riser tube 33, conduit 35, the passage defined within and surrounded by the sealing means 52–55 and hence into the conduit 40 of the mould support 13 and then upwardly to fill the header portion 42 and then to pass into the mould cavity 15 upwardly through the ingate 49. Metal movement is essentially upwards and therefore the benefits of "uphill" filling are achieved, namely lack of turbulent flow downwardly under gravity thereby avoiding entrainment of oxide and other particles in the metal surface thereby avoiding sources of defect nucleation.

Preferably the ingate and mould cavity are designed so that the cavity is filled without any or at least any substantial flow of metal downwardly.

The pressure of the metal in the mould is maintained at a desired low pressure as described hereinbefore.

Figure 2:
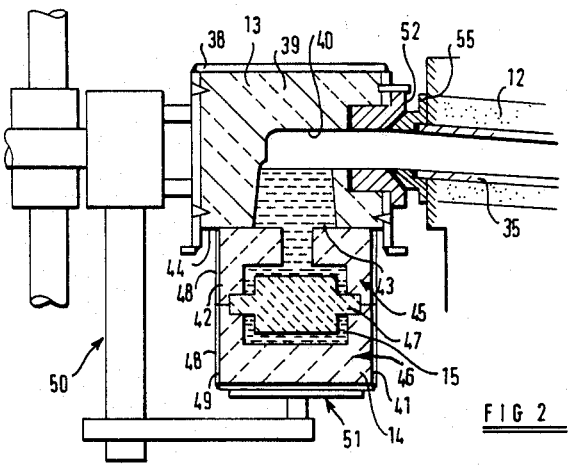
FIG. 2 shows the apparatus of FIG. 1 after filling of the mould cavity with metal from the primary source.

As soon as the mould is filled and with the above described pressure being maintained the manipulator 50 is operated to rotate the mould support/mould assembly 13, 14 about the axis H—H through 180° to invert the support mould assembly 13, 14 to the orientation shown in FIG. 2. Thus the mould cavity is placed out of feeding relationship with the primary source 16 and into feeding relationship with the secondary source 42 when the pressure in the pump is removed to allow the molten metal to fall back through the riser tube 33 out of the conduit 40 and at least partly out of the conduit 35 to the level shown in FIG. 2. Alternatively, if desired the metal may fall completely out of the conduit 35 and riser tube 33 to lie at the same level as the metal surface 34*a* in the vessel 17.

Further alternatively, but not desirably, the pressure may be reduced before or whilst the mould is being inverted to permit of some flow of metal towards the primary source 10. In this case a reserve volume, not shown, may be provided at the opposite end of the mould cavity 15 to the header 42 of a volume to ensure that the cavity remains filled during inversion. Alternatively, the cavity may be allowed to become partially emptied and then refilled from the secondary source when inverted.

The header 42 remains containing metal and thereby, when the mould is inverted, maintains a pressure on the mould in the cavity 15 and feeds the cavity whilst the metal in the cavity 15 solidifies.

It should be noted that because the header is now positioned above the mould cavity 15 heating of the mould cavity by convection from the header or headers is not possible and so the presence of the header does not delay solidification of metal as a result of convection.

As soon as the metal in the conduit 35 of the launder system 12 has cleared the joint 37 the manipulator 50 is operated to move the mould/mould support assembly 13, 14 from the casting station CA by moving the assembly horizontally in the direction of the arrow B away from the launder 12 so separating the surfaces 53, 54 of the joint 37. The manipulator 50 is then operated to rotate the mould support/mould assembly 13, 14 about a vertical axis as indicated by the arrow D and then lowered in the direction of the arrow E so as to move the assembly to the cooling station CO, see FIG. 4 whereat the mould 14 is disposed on a cooling track or conveyor. The plate 51 is then released so that the manipulator 50 can be disengaged from the assembly whilst the weight of the mould support 13 maintains a seal between the surface 44 thereof and the now upper most surface of the mould 14 until the metal in the cavity 15 has solidified.

After the manipulator 50 has separated from the mould support 13 by movement in the direction of arrow B it is rotated about the vertical axis as indicated by the arrow D so as to proceed to a loading station where, after rotation through 180° about the axis H—H, it is engaged with another mould support assembly and mould. The manipulator then moves the further mould support and mould into feeding relationship with the reservoir 17 at the casting station CA surface by moving a surface, corresponding to the surface 53 hereinbefore described, of the new mould support into sealing engagement with the surface 54 of the joint member 55 fixed relative to the conduit 35. Then the cycle is repeated by again causing the pump 32 to pump metal upwardly into the new mould cavity.

In the meantime, after solidification of the metal in the cavity 15 and the header portion 42, the mould support is lifted clear of the mould 14 by any suitable means and returned to the loading station to have a further mould positioned thereon for reuse.

The shape of the header portion 42 is designed to permit the solidified header to remain behind with the mould 14 when the mould support 13 is lifted therefrom after solidification.

It is considered that in a situation where 5–8 castings an hour can be made by hitherto known techniques by using the method and apparatus described above in the region of 25–30 may be made per hour which is, of course, a very substantial increase in casting rate and this increase is achieved with no change in the quality and yield obtained with previously known methods.

If desired the manipulator 50 may be provided with a plurality of clamp plates 51 and means for releasably engaging a mould box, for example four at locations disposed radially around the vertical axis so that operations may be performed sequentially at each location. For example, casting at the casting station, lowering to the cooling track at the cooling station, movement of the mould box to a cleaning station and pick up of a new mould at the loading station. This would realize greater productivity.

Figure 5:
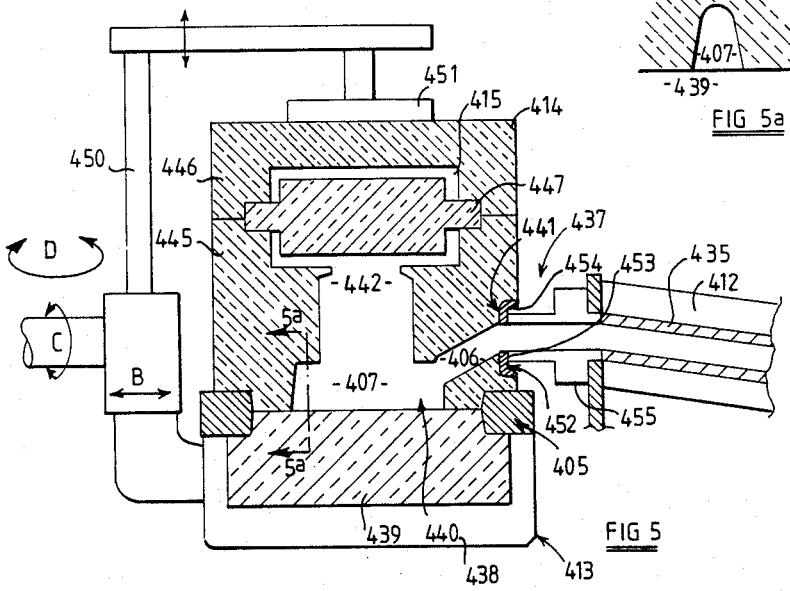
FIG. 5 is a fragmentary diagramatic cross-sectional view through part of a second embodiment of the invention which is a modification of the embodiment shown in FIGS. 1 to 4.
Figure 5A:
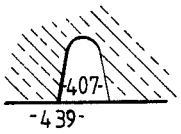
FIG. 5*a* is a section on the line 5*a*—5*a* of FIG. 5.

Referring now to FIG. 5, a modification of the apparatus as described with reference to FIGS. 1 to 4 is illustrated and the same reference numerals, but preceded by a FIG. 4, are used for corresponding parts as were used in FIGS. 1 to 4. In this modification a mould 414 corresponding to the mould 14 of the first described embodiment is of the boxless form and made of bonded sand in conventional manner. The mould 414 comprises cope and drag parts 445, 446 respectively and a mould cavity 415 is defined therein in which at least one core 447 is disposed; although, of course, in this as in all embodiments if desired the mould cavity may be without any core.

In this embodiment the cope part 445 contains a header portion 442 and a conduit 440 comprising a feed passage 406 and a running passage 407.

The mould support 413 is of reduced height compared with the embodiment previously described and the refractory mass 439 is in the form of a insulating slab. The box 438 may be in the form of a frame in which the refractory mass 439 is retained by a clamping ring 405. The refractory slab 439 closes the open section of the part 407 of the conduit 440.

Thus, in this embodiment the header 442 and conduit 440 is part of the mould 414 as is the entry port 441. The primary source and launder are as described in connection with the first embodiment and hence only the end of the launder 412 adjacent the mould 414 is shown. A rotary joint 437 permits of rotation about a horizontal axis, between the mould 414 and the conduit 435 and also permits of movement of the mould 414 from a casting station CA, shown in FIG. 5 to a cooling station similar to the station CO shown in FIGS. 1 to 4. The rotatable and separable joint 437 permits of rotation between the conduits 435 and 440 and provides a seal therebetween. The joint 437 comprises a first member 452 received in a recess in the sand of the cope part 445 and is in the form of a refractory dished washer. The outwardly facing surface of the washer 452 co-operates with an annular surface 454 of a second member 455 fixed relative to the conduit 435.

A seal is maintained between the surface 454 and the outwardly facing surface 453 of the washer 452 by an axial load therebetween imposed by the apparatus.

The washer 452 may contain a filter element of wire fibre-glass or refractory mesh, if desired.

The sequence of operations is as described in connection with the first embodiment and in this case, when in the inverted position, the conduit 440 is drained fully leaving the secondary source or header 442 full.

This arrangement has the advantage of economy, since the header and feed conduit is in the mould; simplicity of sealing, since it is necessary to provide only a simply refractory washer 452; versatility, in that the mould support 413 may be the same for all moulds irrespective of a desired header configuration or feed conduit configuration since each casting type has its own secondary source and feed conduit.

A seal is effected between the bottom of the mould 414 and the refractory mass 439 by a face to face contact under load only, with the clamping ring 405 acting as a sealing "chill" should metal find a small escape path.

The conduit part 406 has a downward inclination in the filling position. This inclination is shown exagerated in FIG. 5 and in practice an initial relatively slow flow rate will not create turbulent conditions as metal flows slightly downwardly along the conduit part 406 and the conduit parts 406 and 407 will quickly fill so that subsequent filling can be carried out rapidly without turbulence at a free surface.

Figure 5B:
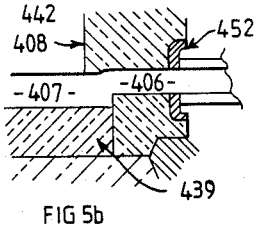
FIG. 5*b* is a fragmentary cross-sectional view through a modification of the embodiment shown in FIG. 5.

If desired the conduit part 406 may be horizontal as shown in FIG. 5*b*.

Figure 6:
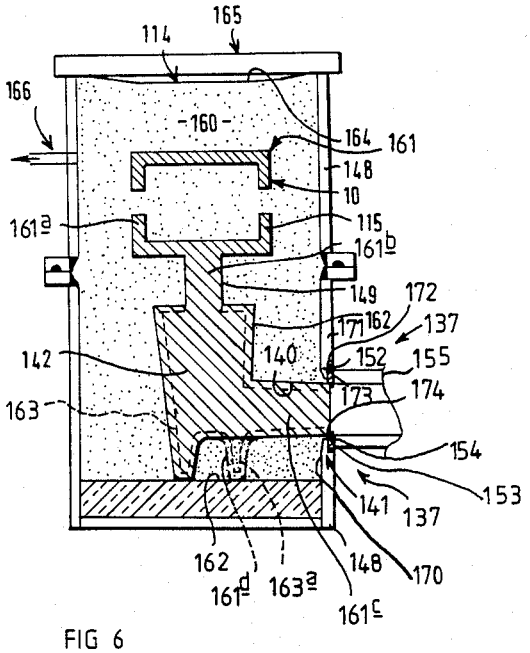
FIG. 6 is a fragmentary diagramatic cross-sectional view through part of a third embodiment of the invention which is a further modification of the embodiment shown in FIGS. 1 to 4.

Referring now to FIG. 6 another modification of the apparatus as described with reference to FIGS. 1 to 4 is illustrated and the same reference numerals, but preceded by a FIG. 1, are used for corresponding parts as were used in FIGS. 1 to 4. In this modification a mould 114 corresponding to the mould 4 of the first described embodiment is made of unbonded sand using an in situ destroyable pattern such as expanded polystyrene and in which a conduit 140 and header portion 142 corresponding to the conduit 40 and header portion 42 of the first described embodiment are defined in unbonded sand using a polystyrene pattern.

In this embodiment a mould box 148 contains unbonded sand 160. Embedded in the same 160 is a polystyrene pattern 161, a part 161*a* of which defines the mould cavity 115 and has a part 161*b* which defines the ingate 149. The pattern 161 parts 161*a*, 161*b* are formed integrally with a further pattern part 161*c* which defines the header portion 142 and conduit 140.

The pattern part 161*c* is formed with a part, in the present example formed as three legs 161*d*, which stands on the upwardly facing surface 162 of the bottom wall of the mould box 148, and preferably locating means are be provided to prevent lateral movement of the pattern 161 relative to the mould box. For example an adhesive may be provided between the surface 162 and the bottoms of the legs 161*d* or a socket, not shown, may be provided in or on the surface 162 in which the bottom ends of the legs 161*d* can be received. The pattern 161 is thus supported and retained in position solely as a result of the above described engagement between the legs 161*d* and the surface 162.

If desired the pattern part 161*a* may be formed separately from and attached to the pattern part 161*b* which may be formed integral with or separately from and attached to the pattern part 161*c* and likewise the pattern part 161*d* may be formed integral with or separately from and attached to the pattern part 161*c*.

Alternatively the pattern 161 may terminate at the upper or lower end of the ingate 149 and be attached to a hollow refractory channel member, which constitutes a permanent pattern, shown in dotted line at 163, the interior of which provides the header portion 142 and conduit 140, and if necessary, the ingate 149. In this case the refractory channel member 163 is provided with a formation to stand on the surface 162 such as legs 163*a* similar to the legs 161*d* described hereinbefore.

The primary source and launder are as described in connection with the first embodiment and hence only a member 155 corresponding to the member 455 of the embodiment described with reference to FIG. 5 is shown. A rotary and separable joint 137 permits of rotation about a horizontal axis between the mould 114 and the conduit 135 and also permits of movement of the mould 114 away from a casting station, shown in FIG. 5, to a cooling station similar to that shown at CO in FIG. 4. The rotary and separable joint 137 permits of rotation between the conduit 135 and conduit 140 and provides a seal therebetween. The joint 137 comprises a first member 152 received on the end of the pattern part 161*c* (or refractory channel member 163 when provided) and accomodated in a recess 170 in the side wall 171 of the mould box 148 and is in the form of a refractory washer. The washer 152 is firmly attached to the pattern part 161*c* (or the refractory channel member 163) but is completely free of attachment to or location by the mould box 148. To that end the recess 170 is of greater diameter than the washer 152 so as to provide a circumferentially extending space 172 therebetween. The washer 152 is positioned on the pattern part 161c (or channel member 163) at such a position as to be adjecent the wall 173 of the recesss 170 so as to prevent passage of sand between the washer and the mould box 148 during filling of the mould box with unbonded sand. The washer is positioned by virtue of a counter bore 174 formed therein of the appropriate depth so that the washer is correctly positioned in relation to the surface 173 when the legs 161d (or 163a) are correctly positioned on the surface 162.

It will be seen, therefore, that the pattern 161 (or conduit member 163) is totally disconnected from the mould box 148 in the region of the entry port 141 and the pattern (or conduit member 163) receive no support nor any location whatsoever from the mould box 148 in the region of the entry port 141. All the support and location being provided solely by the above described engagement of the legs 161d, (163a) with the surface 162.

The outwardly facing surface of the washer 152 cooperates with an annular surface 154 of a second member 155 fixed relative to the conduit 135. A seal is maintained between the surface 154 and the outwardly facing surface 153 of the washer 152 by an axial load therebetween imposed by the apparatus. The washer 152 may contain a filter as described hereinbefore in connection with the washer 452 shown in FIG. 5.

The sand 160 is compacted around the pattern(s) or (patterns(s) and refractory channel member) in conventional manner, for example, by vibration and/or application of vacuum. A flexible sealing member 164, either a rubber sheet or 'cling film' or other suitable material, is retained by a clamp plate 165 and the mould box 148 is provided with a exit port 166 connected to a vacuum pump to enable a vacuum to be drawn to take off products of evaporation of the pattern 160 part 162 if provided and to retain consolidation of the sand.

The mould box 148 is releasable connected to a manipulator identical to the manipulator 50 and the casting operation is as described hereinbefore in connection with the first embodiment except that there is no separation of a mould support from a mould. The whole assembly remains at the cooling station or is moved along the cooling track until the metal has solidified sufficiently for the vacuum to be released and the sand poured out of the mould box 148. Thereafter the mould box 148 is moved to a moulding station where a new pattern(s) (or pattern(s) and refractory channel member) is introduced, washer 152 assembled thereto, and unbonded sand poured therearound followed by consolidation of the sand, application of vacuum and reengagement by the manipulator for movement into feeding relationship with the reservoir 17 at the casting station CA.

If desired the mould box 148 may be a unitary construction or may, as shown in FIG. 6, comprise two parts which may be permanently or releasably connected together. If desired, the whole or part of the bottom wall of the mould box may be separate from the side walls thereof and may, for example, be provided by a suitable support surface against which the side walls abut.

Figure 7:
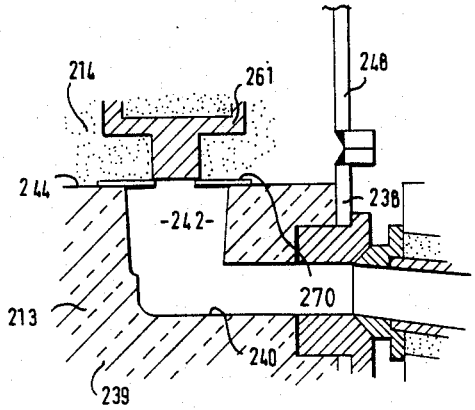
FIG. 7 is a fragmentary diagramatic cross-sectional view through part of a fourth embodiment of the invention which is a further modification of the embodiment shown in FIGS. 1 to 4.

In a modification of the embodiment described with reference to FIG. 6 and illustrated in FIG. 7 in which the same reference numerals but preceded by a FIG. 2 are used for corresponding parts as were used in FIGS. 1 to 4 the mould support 113 may be substantially as described in connection with the embodiment described with reference to FIGS. 1 to 4, namely, comprising a refractory mass in which a conduit 240 and header portion 242 are defined in the same way as the conduit 40 and header portion 42 of the FIGS. 1 to 4 embodiment as is a rotary joint corresponding to the joint 37. In this case a gasket 270 of refractory material is positioned on the top surface 244 of a mould support 213 and a pattern 261 corresponding to the pattern 161 of the FIG. 5 embodiment is rested thereon and sand is poured into a mould box 248 prior to consolidation. The gasket 270 prevents the sand from filling the header portion 242. In this modification the casting operation is essentially as described in connection with the first embodiment in that after cooling at the cooling station CO for a sufficient period of time for the metal to solidify adequately, the mould support 213 is lifted away from the mould 214 whilst solidification in the mould continues. If desired to facilitate this, a further flexible seal closure may be provided between the mould support 213 and the mould 214 so that the vacuum is maintained after the mould support 213 has been removed. The mould support 213 is then moved back to the loading station for assembly of a further mould 214 thereon followed by a movement by the manipulator of the new assembly back into feeding relationship with the reservoir 17.

Figure 3:
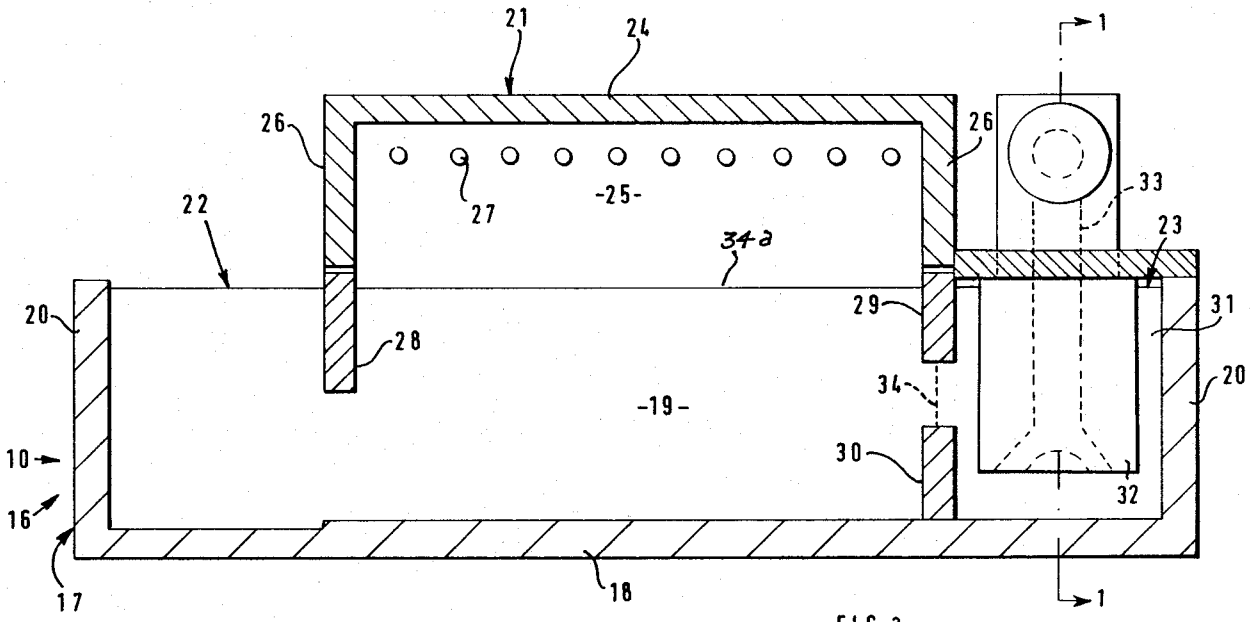
FIG. 3 is a fragmentary cross-sectional view on the line 3—3 of FIG. 1.
Figure 8:
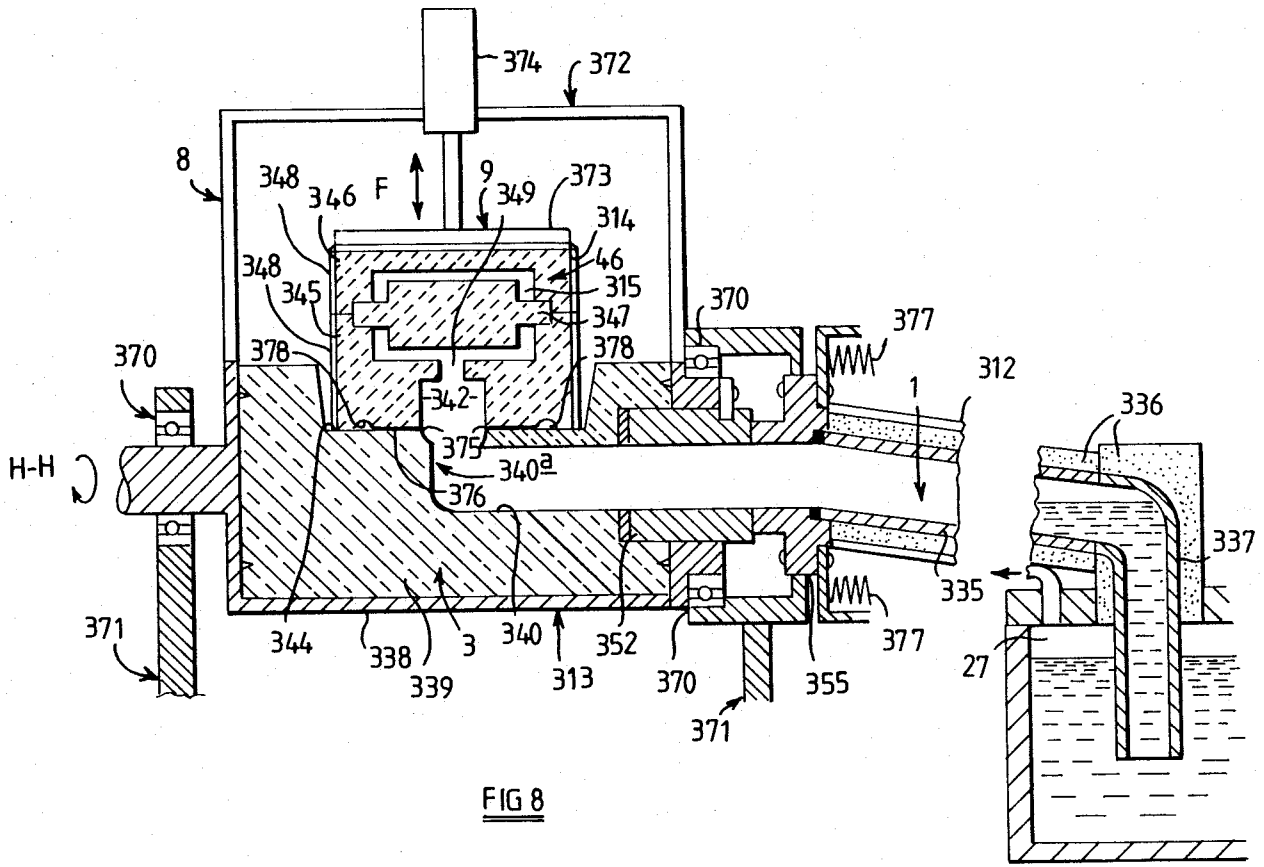
FIG. 8 is a diagramatic cross sectional view through a fifth embodiment of the invention.

Referring now to FIG. 8, there is shown a further embodiment of the invention and the same reference numerals but preceded by a FIG. 3 have been used for corresponding parts as were used in FIGS. 1 to 4. In this embodiment a mould support 313 comprising a steel box 338 is mounted for rotation about a horizontal axis H—H by bearings 370 the outer races of which are carried on uprights 371. The box 338 has mounted thereon a manipulator means 372 which comprises a clamp plate 373 moveable in the direction of the arrow F by a pneumatic ram 374. The box 338 contains a refractory mass 339 within which is defined a conduit portion 340 which has an upwardly extending end part 34a.

The upper surface of the refractory mass 339 receives and supports a mould 314 made as described in connection with the first embodiment described with reference to FIGS. 1 to 4 thus comprising cope and drag parts 345, 346 and is arranged to be clamped to the mould support 313 by the clamping plate 373 of the manipulator 372. The mould 314 has a mould cavity 315 defined by the cope and drag parts 345, 346 and has at least one core 347 therein. An ingate 349 communicates with a header portion 342 which is connected in communication with the upwardly extending part 340a of the conduit 340.

A gasket 375 is disposed betwen the surface 376 of the mould and the surface 344 of the mould support 313 to provide a seal there between. The apparatus is provided with a primary source of metal 316 which comprises a holding furnace 317 to which metal is fed in molten state and pumped therefrom, by pressurising the interior of the vessel 317, through a riser tube 333 and launder system 312 corresponding to that of the first embodiment. If desired, alternatively, the metal may be pumped from the holding furnace 317 by using a pump separate from the furnace such as a pump similar to the electro magnetic pump 32 or pressure pump described in connection with the embodiment of FIGS. 1 to 4. Further alternatively the primary source may be provided by a melter/holder furnace and fed therefrom as described in connection with the embodiment of FIGS. 1 to 4.

The conduit part 335 is connected to the mould support 313 and in particular the conduit 340 thereof by a rotary joint 337 which, in the present embodiment is not capable of separation but only or rotation. The rotary joint is made between refractory faced parts 352 and 355 provided with cooperating sealing surfaces 353, 354 which, in the present example, are annular. Surfaces 353, 354 are maintained in sealing example by resilient biasing means such as coil compression springs 377 and sufficient flexibility is built into the launder system 312 to permit such biasing to occur.

In use, a mould 314 is picked up at a loading station by a suitable mechanical handling means and moved into position to rest on the surface 344 of the mould support 313 with a gasket 375 there between. The manipulator 372 is then activated to clamp the mould 314 in position with the clamping plate 373.

The vessel 317 is then pressurized to pump metal upwardly through the conduit 335 and into the conduit 340 and hence upwardly through the part 340*a* thereof into the header portion 342, ingate 349 and cavity 315. The mode of upward feeding is therefore essentially as described within the previous embodiment and the same advantages accrue.

When the mould cavity 315 is filled and whilst pressure is maintained, of the same magnitude as previously described, the mould support 313 and mould 314 supported thereon are rotated about the axis H—H through 180° by a suitable rotating mechanism and then the applied metal pressure is removed and the metal in the conduit 340 allowed to flow back into the reservoir. Again the metal may be lowered to the extent that the conduit 340 is empty whilst metal still remains in at least part of the riser tube or metal may be allowed to fall back within the riser tube to the same level as the free surface of the metal in the reservoir 17.

As soon as the metal has fallen to clear the conduit 340 the mould 314 is lowered from contact with the mould support 313 by lowering the clamping plate 373. The thus inverted mould can then be removed laterally by a suitable mechanical handling device. A head of metal is maintained by the enlarged header portion 342 of the ingate 349 in the mould itself so that a, reduced, pressure is maintained applied to the metal in the mould cavity 315 and to feed the cavity 315 during solidifcation. A small residual volume of metal will not fully drain towards the reservoir adjacent to the ingate, when in the inverted position and, if this is not retained by its oxide film and surface tension, provision may be made to prevent it flowing from the mould by providing a gutter as shown at 378.

If desired, the embodiment shown in FIG. 9 may be modified for use with a mould made of non-bonded sand using an in situ destroyable pattern simply by providing a suitable moulding box containing unbonded consolidated sand surrounding such a pattern in place of the mould 314 described herein before. The expanded polystyrene pattern may provide the whole of the mould cavity 315, ingate 349 and header portion 342. Alternatively, if desired, the header portion 342 and ingate 349 may be provided by a refractory shell.

In all the embodiments described hereinbefore a filter, such as the filter F shown in dotted line in FIG. 1 may be placed in the path of flow of metal from the reservoir to the mould cavity to further control movement of contaminates to the mould cavity. The filter in the example illustrated is a disc of ceramic filter material located between the first member 52 and the refractory mass 39 in place of the jointing gasket 39*a*.

Although in the examples described above the longitudinal axis of the openings for the passage of metal through the first and second members of the rotary joints have coincided with the axis of rotation of the mould cavity if desired, the or each of said longitudinal axes may be offset from the axis of rotation so as to perform a circular orbital motion around said axis. Moreover the mould cavity as a whole may be moved in a circular or other path, for example elliptical or an irregular path about a horizontal or substantially horizontal axis to change the orientation of the mould cavity relative to the direction of gravity. Any motion which results in a complete or partial inversion of the mould cavity is to be regarded as falling within the ambit of this invention and of the appended claims. Although in the above example the cavity has been fully inverted that is, rotated through 180° from the position it occupies during filling, if desired, it may be only partially inverted, the angular disposition of the feeds from the primary source and from the secondary source being such as to prevent flow of metal from the cavity towards the primary source and to permit flow of metal from the secondary source to the cavity when the mould have been inverted to the desired extent. The term "inverted" is used in the claims hereof to refer to both such partial inversion as well as full inversion.

Although in the above examples the metal is fed by being subjected to a pressure above atmospheric, if desired, the metal may be fed from the primary source into the mould cavity by imposing a pressure below atmospheric in the mould cavity and the metal in the primary source being subject to a higher pressure.

In the above example the mould cavity has been completely filled with metal from the primary source prior to the commencement of changing the orientation of the mould cavity relative to the force due to gravity. However, if desired, the mould cavity may be only partially filled prior to the commencement of change in orientation, the head required for partial filling being maintained by the pump during change in orientation the mould cavity then being further filled by virtue of flow of metal from the primary source.

In all embodiments described hereinbefore the advantages accruing from bottom filling of the mould are attained and in addition the inversion of the mould and its removal from feeding relationship with the primary source allow solidification at a location remote from the casting station and therefore permits a further mould to be moved into feeding relationship with the mould cavity at the casting station much more quickly than has been possible hitherto where a mould has had to remain in feeding relationship at the casting station until the metal in the moulds has solidified.

The continuous connection of the mould cavity to the primary source during the above described change in orientation permits the metal in the mould cavity to be subjected to the same pressure during inversion as is applied during feeding. Moreover, when after inversion, preparations are made for separating the mould cavity from the primary source the flow of metal from the launder and conduit upstream of the header portion is within a closed conduit hence the casting regime can be carefully controlled and any desired rate of metal flow or pressure regime may be imposed.

Although the means for continuously connecting the mould cavity to the primary source during said change in orientation in the embodiments described hereinbefore comprises feeding the metal through a rotatable joint, if desired other means may be provided. For example, it is believed that a flexible or articulated conduit may be a possible alternative although the applicants have not constructed such an alternative.

In all the embodiments described hereinbefore the moulds may be made of any suitable particulate material such as silica sand but are preferably wholly or substantially wholly zircon sand.

In all the embodiments described hereinbefore after the metal in the mould cavity has solidified the resulting casting is removed from the mould using conventional techniques to remove the sand. For example, a conventional knock-out, when using bonded sand, or pouring out of the sand, when using unbonded sand with an in situ destroyable pattern.

The invention may also be applied to shell moulds and in this case the castings are removed by breaking the shell mould.

The invention may also be applied to permanent moulds having at least two separable parts made, for example, of steel, defining therebetween the mould cavity. Such shell moulds or permanent moulds may be provided instead of the bonded sand mould of the previously described embodiments.

The method and apparatus described herein before may be used in a foundry for any desired shape of casting and in particular for castings which are cast to a finished or semi finished shape.

The features disclosed in the foregoing description, or the accompanying drawings, expressed in their specific forms or in terms of a means for performing the disclosed function, or a method or process for attaining the disclosed result, may, separately or in any combination of such features, be utilised for realising the invention in diverse forms thereof.

I claim:

1. A method of making a casting comprising the steps of, at a casting station, feeding molten metal from a primary source of molten metal into a mould cavity through an ingate below the top of the mould cavity, placing the cavity out of feeding relationship with the primary source comprising causing relative movement between the cavity and the primary source to change the orientation of the cavity relative to the direction of gravity to prevent flow of molten metal from the cavity towards the primary source and to permit of flow of metal from a secondary source to the cavity, the cavity being continuously connected to the primary source during said change of orientation, and separating the cavity from the primary source, maintaining the primary source at the casting station, transferring the mould cavity to a cooling station spaced from the casting station and, at the cooling station, permitting molten metal to flow to the cavity from the secondary source whilst the metal in the cavity solidifies.

2. A method according to claim 1 wherein the cavity is inverted by rotating the cavity about a horizontal or substantially horizontal axis.

3. A method according to claim 2 wherein the metal is fed to the cavity from the primary source along a path through a rotary joint comprising a first member rotatable relative to a second member and a sealing means which permits of relative rotation between said members and encircles the path of flow of the metal.

4. A method according to claim 1 wherein the metal is fed by being pumped generally upwardly into the cavity from a reservoir which comprises the primary source.

5. A method according to claim 1 wherein the metal in the mould cavity is subjected to a low pressure above atmospheric sufficient to ensure that metal is fed to the cavity.

6. A method according to claim 5 wherein the metal in the cavity is maintained subject to said pressure during said change in orientation.

7. A method according to claim 1 wherein the secondary source comprise a header and metal is fed from the primary source to the cavity through the header.

8. A method according to claim 7 wherein after the mould cavity has been placed in feeding relationship with the secondary source a head is maintained to provide a pressure in the metal in the cavity of the same order of magnitude as a low pressure above atmospheric to which the metal is subjected to feed metal to the cavity.

9. A method according to claim 1 wherein the method includes the step of placing a further mould cavity in feeding relationship with the primary source after placing the first mentioned mould cavity out of feeding relationship therewith but before the metal in the first mentioned mould cavity has solidified to the extent that metal does not flow from the secondary source into the mould cavity.

10. An apparatus for making a casting comprising a primary source for molten metal, a mould having a mould cavity, feed means to feed molten metal, in use, from the primary source into the mould cavity through an ingate below the top of the mould cavity, when the mould is at a casting station, means for placing the mould cavity out of feeding relationship with the primary source comprising means to cause relative movement between the cavity and the primary source to change the orientation of the mould cavity relative to the direction of gravity to prevent flow of molten metal from the cavity towards the primary source and to permit of flow of metal from a secondary source to the cavity, means continuously to connect the cavity with the primary source during said change of orientation, means to separate the cavity from the primary source, means to maintain the primary source at the casting station and means to transfer the mould cavity to a cooling station spaced from the casting station whereat molten metal may flow to the cavity from the secondary source whilst the metal in the cavity solidifies.

11. An apparatus according to claim 10 wherein said means for inverting the mould cavity comprises means for rotating the cavity about a horizontal or substantially horizontal axis.

12. An apparatus according to claim 11 wherein the apparatus includes a passage to provide a path for flow of metal from the primary source to the mould cavity extending generally upwardly from the primary source to the mould cavity and including a horizontal or substantially horizontal portion which is provided with a rotary joint comprising a first conduit, rotatable relative to a second conduit fixed relative to the primary source, there being sealing means therebetween which permits of the first and second conduits to rotate relative to each other while sealing the joint therebetween and encircling the path of flow of the metal.

13. An apparatus according to claim 10 wherein the feed means comprises means for pumping the metal generally upwardly into the cavity from a reservoir for molten metal.

14. An apparatus according to claim 10 wherein the apparatus comprises means for subjecting the metal in the mould cavity to a low pressure sufficient to ensure that the metal is fed to the cavity.

15. An apparatus according to claim 10 wherein the mould cavity is removably mounted on a mould support which includes a passage for flow of metal therethrough from the primary source to the mould cavity, the passage leading to a header portion which provides the secondary source, the header portion being disposed between the cavity and the passage in the mould support.

16. An apparatus according to claim 15 wherein the mould support comprises the header portion.

17. An apparatus according to claim 15 wherein the mould comprises the header portion.

18. An apparatus according to claim 12 wherein the rotatable joint is separable so that the first and second conduits can be separated from each other to enable removal of the mould from the casting station.

19. An apparatus according to claim 18 wherein the mould support is connected to a manipulator to rotate the mould support about said axis, to move the mould support from the said casting station to the cooling station and to maintain the mould in casting relationship with the support.

20. An apparatus according to claim 19 wherein after moving the mould support and mould thereon out of feeding relationship with the first source at the casting station to the cooling station the manipulator is disengagable therefrom and movable to a loading station where it is engageable with a further mould support and mould and operable to move the further mould support and mould into feeding relationship with the primary source.

21. An apparatus according to claim 15 wherein the mould support comprises said passage for flow of metal and the mould, which is removable mounted on the mould support, is itself provided with a header portion.

22. An apparatus according to claim 21 wherein the rotatable joint is not separable but the mould is removable from the mould support after inversion.

23. An apparatus according to claim 22 wherein the support includes a handling means adapted to maintain the mould in feeding relationship with the mould support during feed of metal from the primary source into the mould cavity and to permit of removal of the mould from the mould support after inversion so that the mould can be moved from the casting station to the cooling station.

24. An apparatus according to claim 23 wherein the mould support is constructed to permit a mechanical handling device to gain access to the mould when inverted to permit of the removal of the mould from the casting station to the cooling station.

25. An apparatus according to claim 10 wherein the mould comprises any one of: at least two assembled together parts made in bonded sand defining therebeween the mould cavity, which may have one or more cores therein; a mould box containing unbonded sand having embedded therein an in situ destroyable pattern which defines said mould cavity; or a permanent mould having at least two separate parts defining therebetween the mould cavity.

26. An apparatus according to claim 10 wherein the mould includes a passage for the flow of metal therethrough from the primary source to the mould cavity, the passage leading to a header portion which provides a secondary source, the header portion being disposed between the cavity and the passage in the mould.

27. An apparatus according to claim 26 wherein the mould comprises a mould box containing unbonded sand having embedded therein an in situ destroyable pattern which defines the mould cavity.

28. An apparatus according to claim 27 wherein the unbonded sand has embedded therein an in situ destroyable pattern which defines a member of the group consisting of the passage and the header portion.

29. An apparatus according to claim 27 wherein the unbonded sand has embedded therein a permanent pattern which defines a member of the group consisting of the passage and the header portion.

30. An apparatus according to claim 27 wherein the pattern which defines the mould cavity is located and supported within the mould at a position spaced from the entry port of the metal from the primary source into the mould box.

31. An apparatus according to claim 30 wherein the entry port is in a side wall of the mould box and metal passes through said side wall in a horizontal or generally horizontal direction and the pattern is supported and located by a bottom wall of the mould box.

* * * * *